US009171683B2

(12) United States Patent
Harada et al.

(10) Patent No.: US 9,171,683 B2
(45) Date of Patent: Oct. 27, 2015

(54) SEALED AND VENTED SWITCH ACTUATOR

(75) Inventors: Atsushi Harada, Saitama (JP); Kohki Kamagome, Saitama (JP); Kiyotsugu Arai, Fujioka (JP)

(73) Assignees: HUSQVARNA ZENOAH CO., LTD., Saitama (JP); NITTEI MUSEN CO., LTD., Gunma (JP)

( * ) Notice: Subject to any disclaimer, the term of this patent is extended or adjusted under 35 U.S.C. 154(b) by 132 days.

(21) Appl. No.: 13/810,263

(22) PCT Filed: Jul. 15, 2010

(86) PCT No.: PCT/JP2010/004603

§ 371 (c)(1),
(2), (4) Date: Jan. 15, 2013

(87) PCT Pub. No.: WO2012/007997

PCT Pub. Date: Jan. 19, 2012

(65) Prior Publication Data

US 2013/0112534 A1 May 9, 2013

(51) Int. Cl.

| | |
|---|---|
| ***H01H 19/06*** | (2006.01) |
| ***H01H 9/04*** | (2006.01) |
| ***H01H 23/06*** | (2006.01) |
| ***H01H 23/20*** | (2006.01) |

(52) U.S. Cl.
CPC ..... *H01H 9/047* (2013.01); *H01H 23/06* (2013.01); *H01H 23/205* (2013.01)

(58) Field of Classification Search
USPC ..... 200/302.1, 302.2, 302.3
See application file for complete search history.

(56) References Cited

U.S. PATENT DOCUMENTS

| | | | | |
|---|---|---|---|---|
| 4,754,110 | A * | 6/1988 | Craft | 200/302.2 |
| 4,937,407 | A * | 6/1990 | Osika | 200/302.3 |
| 6,103,981 | A * | 8/2000 | Kremer | 200/296 |
| 6,380,500 | B1 * | 4/2002 | Lin | 200/302.3 |
| 2005/0173236 | A1 | 8/2005 | Lai | |

FOREIGN PATENT DOCUMENTS

| | | | |
|---|---|---|---|
| DE | 102006039372 | A1 | 3/2008 |
| EP | 0757368 | A2 | 2/1997 |
| GB | 2374981 | A | 10/2002 |

OTHER PUBLICATIONS

International Search Report and Written Opinion of PCT/JP2010/004603 mailed Apr. 1, 2011.
Chapter II International Preliminary Report on Patentability of PCT/JP2010/004603 mailed Jul. 24, 2012.

* cited by examiner

*Primary Examiner* — Vanessa Girardi
(74) *Attorney, Agent, or Firm* — Nelson Mullins Riley & Scarborough LLP

(57) ABSTRACT

The present invention relates to a switch device (100) for use in hand-held power tools. The switch device (100) may include at least one chamber (102) whose interior serves as an accommodation space. The chamber (102) may partially encase an operational member (104) for actuating the hand-held power tool through the switch device (100). Further, the switch device (100) is provided with multiple holes (202) on side walls (204) of the chamber (102) to create a passageway for external particulate materials. Also, a bottom surface (205) of the chamber (102) may be sloped to extend from an interior of the chamber (102) to each of the multiple holes (202), to enhance the discharging of the external particulate materials through the holes (202).

20 Claims, 7 Drawing Sheets

SEALED AND VENTED SWITCH ACTUATOR

TECHNICAL FIELD

The present invention relates to a switch device, more particularly to a switch device for a hand-held power driven working tool.

BACKGROUND ART

A hand-held power tool, such as a chain saw, may use a switch device for actuation of electrical supply in the hand-held power tool. Generally, rocker type switch device are used in the hand-held power tools. However, other types of switch device, such as, but not limited to, toggle switch device, push button switch device, momentary switch device, or the like may also be used in similar operations.

The switch devices used in the hand-held power tool include one or more chambers to accommodate an operational member and a contact member. The hand-held power tool may encounter external particulate materials around/into the switch device while the hand-held power tool is in operation. The external particulate materials may include saw dust, dirt, or the like. These external particulate materials may affect the overall performance of the switch device.

Various measures have been adopted in the art to protect the operational member and the contact member of the switch device. One way is to seal the contact member that may at least partly reduce abrasion between the contact member and a pressing member. In other cases, measures have been taken to enclose the switch device within a protective housing to protect the switch device from the external environment.

SUMMARY OF INVENTION

Technical Problem

However, the sealing of the contact member may not simultaneously protect the operational member. When the housing is used, the housing typically may not furnish the flexibility needed to responsively cycle the switch. Moreover, most of the hand-held power tools are exposed to rather rough handling and, as a consequence, the seals may be broken or dislodged, thereby defeating the protection afforded by the housing.

In light of the foregoing, there is a need for a switch device for the hand-held power tool to protect the operational member and the contact member without any complicated construction or decreasing the overall efficiency of the switch device.

In view of the above, it is an objective of the present invention to solve or at least reduce the problems discussed above. In particular, the objective is to provide an improved switch device for a hand-held powered tool such that protection of the switch device with a simple construction is achieved. Moreover, the switch device may have an improved discharge efficiency of external particulate materials.

Solution to Problem

The objective is at least partly achieved according to the novel switch device for a hand-held power tool described in claim 1. The switch device may include a chamber whose interior serves as an accommodation space. The switch device further includes an operational member which is partially located in the chamber. Further, the switch device is provided with a hole on side walls of the chamber. In an aspect of the present invention, the hole may provide a passageway for the discharge of the external particulate material encountered during an operation of the hand-held power tool. Further, the switch device is also provided with a bottom surface at least partly sloped which extends from an interior of the chamber to the hole. In the above aspect of the present invention, the sloped bottom surface may facilitate an enhanced discharge of the external particulate materials through the passageway provided in terms of the hole. Further, in the above aspect of the present invention, this switch device may be implemented in any existing switch device that includes a hole around a housing.

According to claim 2, there are at least two holes provided on the side walls of the chamber.

According to claim 3, there are four holes provided on the side walls of the chamber.

According to claim 4, there are six holes provided on the side walls of the chamber.

According to claim 5, there are two holes provided on the side walls perpendicular to the longitudinal axis of the chamber.

According to claim 6, there are at least two holes provided on the side walls perpendicular to the transverse axis of the chamber.

According to claim 7, there are four holes provided on the side walls perpendicular to the transverse axis of the chamber.

According to claim 8, the holes in the switch device create a passageway for the external particulate material.

According to claim 9, the external particulate material includes dust.

According to claim 10, the switch device includes a rocker switch, a toggle switch or a push button switch.

According to claim 11, the switch device is used in a hand-held powered tool.

BRIEF DESCRIPTION OF DRAWINGS

The invention will be described in more detail with reference to the enclosed drawings.

DESCRIPTION OF EMBODIMENTS

Figure 1:
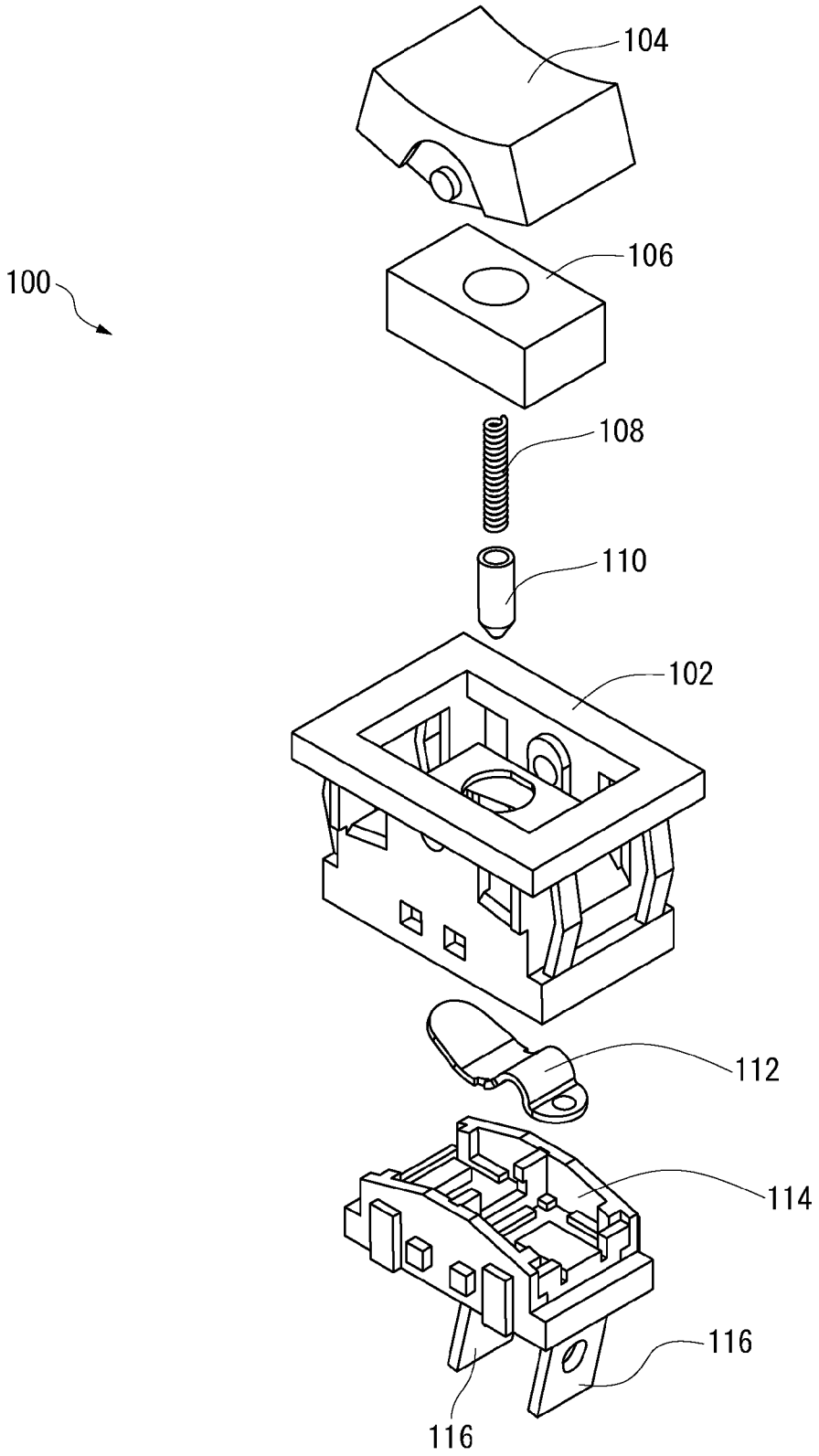
FIG. 1 illustrates an exploded view of a switch device, according to a first exemplary embodiment of the present invention.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention can be utilized in other embodiments and even other types of devices. In the drawings, like numbers refer to like elements.

FIG. 1 illustrates an exploded view of an exemplary switch device 100, according to a first exemplary embodiment of the present invention. Although the described example in FIG. 1 is a rocker switch device, it should be understood that the present invention could be incorporated into any suitable type of switch device, such as, but not limited to, toggle switch, pushbutton switch, micro switch, selector switch, or the like. Further, the switch device 100 may be used in various hand-held powered tools (not shown in the FIGS.), such as, but not limited, to brush cutters, chain saws, hedge trimmers, rotary saws or any other power tool, or various outdoor equipment. In addition, any suitable size, shape or type of elements or materials may be used.

Referring to FIG. 1, the switch device 100 may include a chamber 102 whose interior serves as an accommodation space. Further, an operational member 104 may be accommodated in the chamber 102. The operational member 104 may be a switch button, which is used to actuate switching components to complete an electrical connection in the hand-held power tool. In the first exemplary embodiment of FIG. 1, the operational member 104 may be an operational member 104 of a rocker switch. The operational member 104 of such a switch is featured with a momentary operation. During momentary operation, the electrical connection may remain in operation till the operator pushes the operational member 104 (shown in FIGS. 2 and 3) and the operational member 104 may return to its neutral position, thereby breaking the electrical connection, when the operator pushes the operational member 104.

In the first exemplary embodiment of the present invention, the operational member 104 may be made of an insulating material, such as, plastic or the like. The operational member 104 may be positioned on a sealing member 106. The sealing member 106 along with the operational member 104 may be accommodated in the chamber 102 as shown in FIG. 1. In the first exemplary embodiment of the present invention, the sealing member 106 may be suitably made up of an organic polymeric material, which is elastic in nature, such as, but not limited to, hydrocarbon elastomer, ethylene-propylene copolymer, natural rubber, polyvinyl chloride or the like.

Further, the chamber 102 may be shaped in accordance with the shape of the sealing member 106 so that the operational member 104 may be easily accommodated in the chamber 102. The sealing member 106 is provided with an opening at the centre to receive an elastic member 108. In the first exemplary embodiment of the present invention, the elastic member 108 may be a coil spring. Further, the elastic member 108 may be housed within a pressing member 110. The pressing member 110 and the elastic member 108 may together form the contact member. The contact member protrudes through the chamber 102 to approach a contact plate 112 in an additional chamber 114 provided underneath the chamber 102. In the first exemplary embodiment of the present invention, the contact plate 112 may be made of an electrically conducting material. In the first exemplary embodiment of the present invention, the sealing member 106 may prevent the contact member and the contact plate 112 from abrasion. The sealing member 106 may prevent the external particulate materials from reaching the contact plate 112.

As shown in FIG. 1, the contact plate 112 may act as intermediate member between the contact member and a pair of conducting terminals 116. The conducting terminals 116, placed at the bottom of the additional chamber 114, may be provided to establish the electrical connection in the hand-held power tool. Further, the additional chamber 114 may protect the contact member from the external environment. Additionally, the chamber 102 and the additional chamber 114 may be arranged in a snap-fit arrangement without requiring any additional fastening components, for example, bolts, nuts etc.

Figure 2:
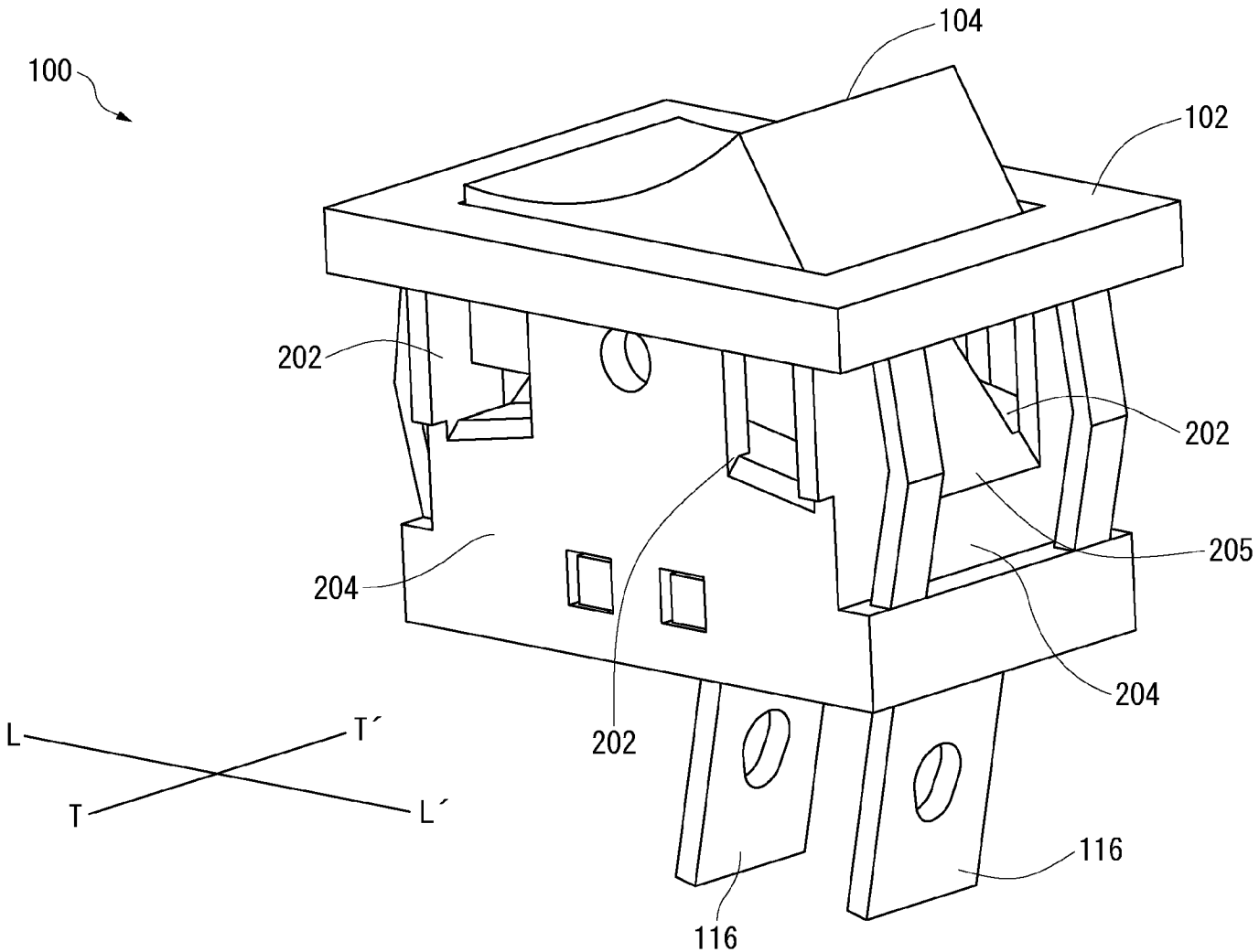
FIG. 2 illustrates a perspective view of an assembled switch device, according to the first exemplary embodiment of the present invention.

In the first exemplary embodiment of the present invention, as shown in FIG. 2, the switch device 100 may include a plurality of holes 202 on side walls 204 of the chamber 102. In the first exemplary embodiment of the present invention, the switch device 100 may include six holes 202 on the side walls 204 of the chamber 102 and further, a bottom surface 205 of the chamber 102 may be sloped to extend from an interior of the chamber 102 to each of the six holes 202 (described in conjunction with FIG. 2). In a second exemplary embodiment of the present invention, the switch device 100 may include at least four holes 202 on the side walls 204 of the chamber 102 and may further include a U-shaped member on the side walls 204 of the chamber 102 (described in conjunction with FIG. 4 and FIG. 5). In a third exemplary embodiment of the present invention, the switch device 100 may include at least four holes 202 and the bottom surface 205 is partly sloped to extend from an interior of the chamber to each of the four holes 202 (described in conjunction with FIG. 6).

FIG. 2 illustrates a perspective view of an assembled switch device 100, according to the first exemplary embodiment of the present invention. As shown in FIG. 2, the switch device 100 may include multiple holes 202 on the side walls 204 of the chamber 102. In the first exemplary embodiment of the present invention, the switch device 100 may include six holes 202 on the side walls 204 of the chamber 102. In the first exemplary embodiment of FIG. 2, two holes 202 are provided on the side walls 204 perpendicular to a longitudinal axis (LL') of the chamber 102 and four holes 202 are provided on the side walls 204 perpendicular to a transverse axis (TT') of the chamber 102.

Further, in the first exemplary embodiment of the present invention, the bottom surface 205 of the chamber 102 may be sloped to extend from the interior of the chamber 102 to each of the six holes 202 located on the side walls 204 of the chamber 102. In a modification of the present invention, the switch device 100 may include a separate member (not shown), with a sloped bottom surface 205, that may be accommodated in the chamber 102. In the first exemplary embodiment of the present invention, the separate member may be integrally formed with the chamber 102. In the modification of the present invention, the separate member may be glued to the chamber 102 of the switch device 100. The sloped bottom surface 205 of the separate member may extend from an interior of the chamber 102 to each of the six holes 202.

In various situations, the hand-held power tools may encounter external particulate materials, such as, but not limited to, dust, sand, grass or the like, during an operation of the hand-held power tool. For example, during an operation of a chain saw, dust may gather inside the chamber 102 of the switch device 100, which in turn may restrict the operation of the hand-held power tool. The presence of these external particulate materials inside and around the chambers may interfere with a normal operation of the switch device 100 and occasionally render the switch device 100 inoperable. In the embodiments of the present invention, the holes 202 provided in the switch device 100 may create a passageway (not shown) for external particulate materials to discharge from the switch device 100. Also, since the bottom surface 205 of the chamber 102 is sloped, it may enhance the discharging efficiency of external particulate materials though the holes 202 provided in the switch device 100.

It may be apparent to a person skilled in the art that the invention is not limited to any particular switch device 100 and thus, could be implemented in any model of the switch device 100 without departing from the scope of the present invention. In particular, the present invention may be implemented in any existing switch device 100 that includes holes around a housing. Thus, the invention in various embodiments, may be incorporated regardless of any model for the switch device 100.

Figure 3:
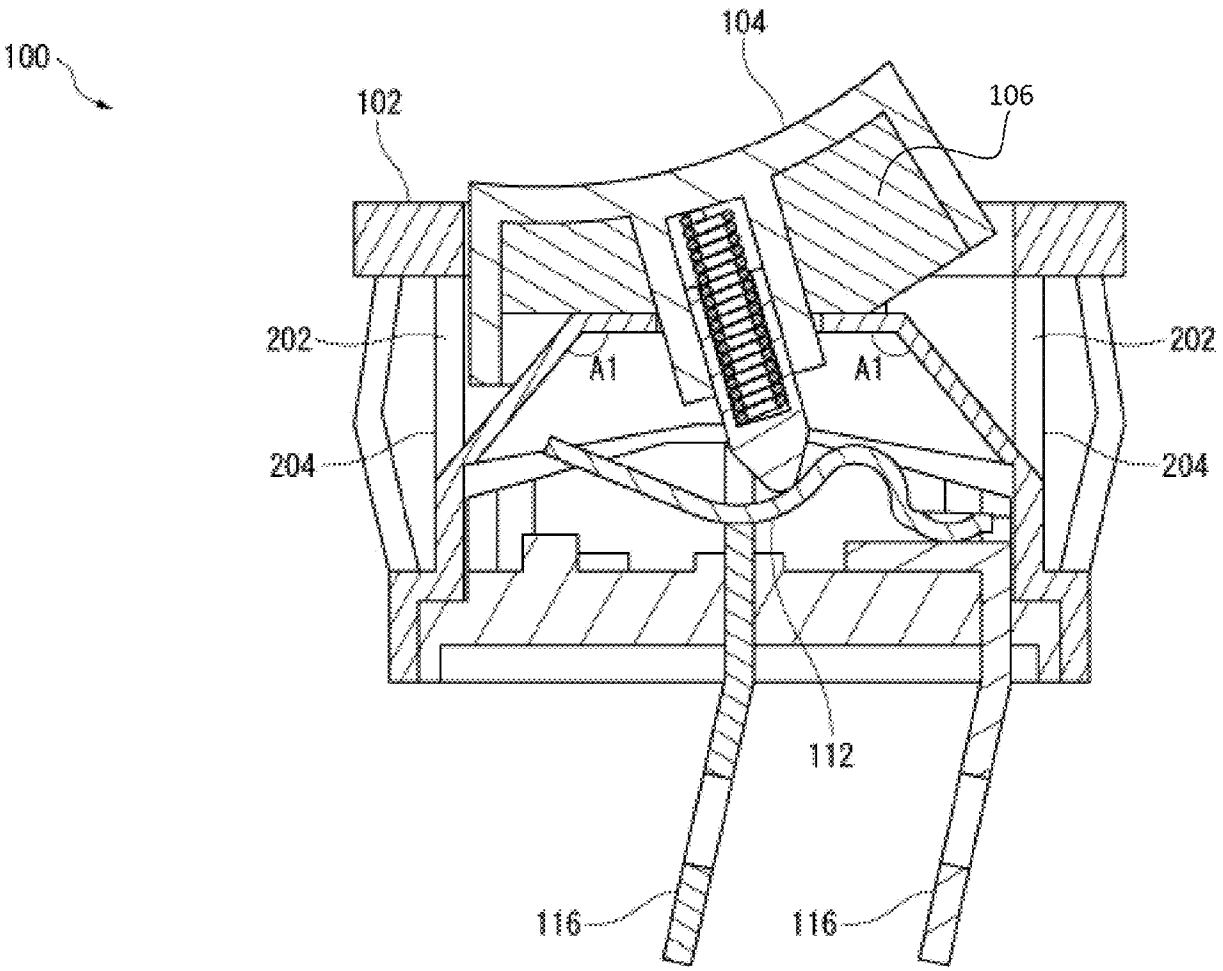
FIG. 3 illustrates a cross-sectional view of the switch device of FIG. 2, according to the exemplary first embodiment of the present invention.

FIG. 3 illustrates a cross-sectional view of the switch device 100 illustrated in FIG. 2, according to the first exemplary embodiment of the present invention. As shown in FIG. 3, the bottom surface 205 of the chamber 102 may be at least partly sloped to extend from the interior of the chamber 102 to the respective holes 202 located on the side walls 204. The slope may be inclined at a first angle A1 with respect to the longitudinal axis (LL') of the chamber 102. In the first exemplary exemplary embodiment of the present invention, the first angle A1 of the slope may be in a range from about 30 degrees to 60 degrees. The slopes may be extended to allow external particulate materials to flow towards the holes 202 provided on the side walls 204 of the chamber 102. Subsequently, these concentrated external particulate materials may be discharged through the holes 202.

Figure 4:
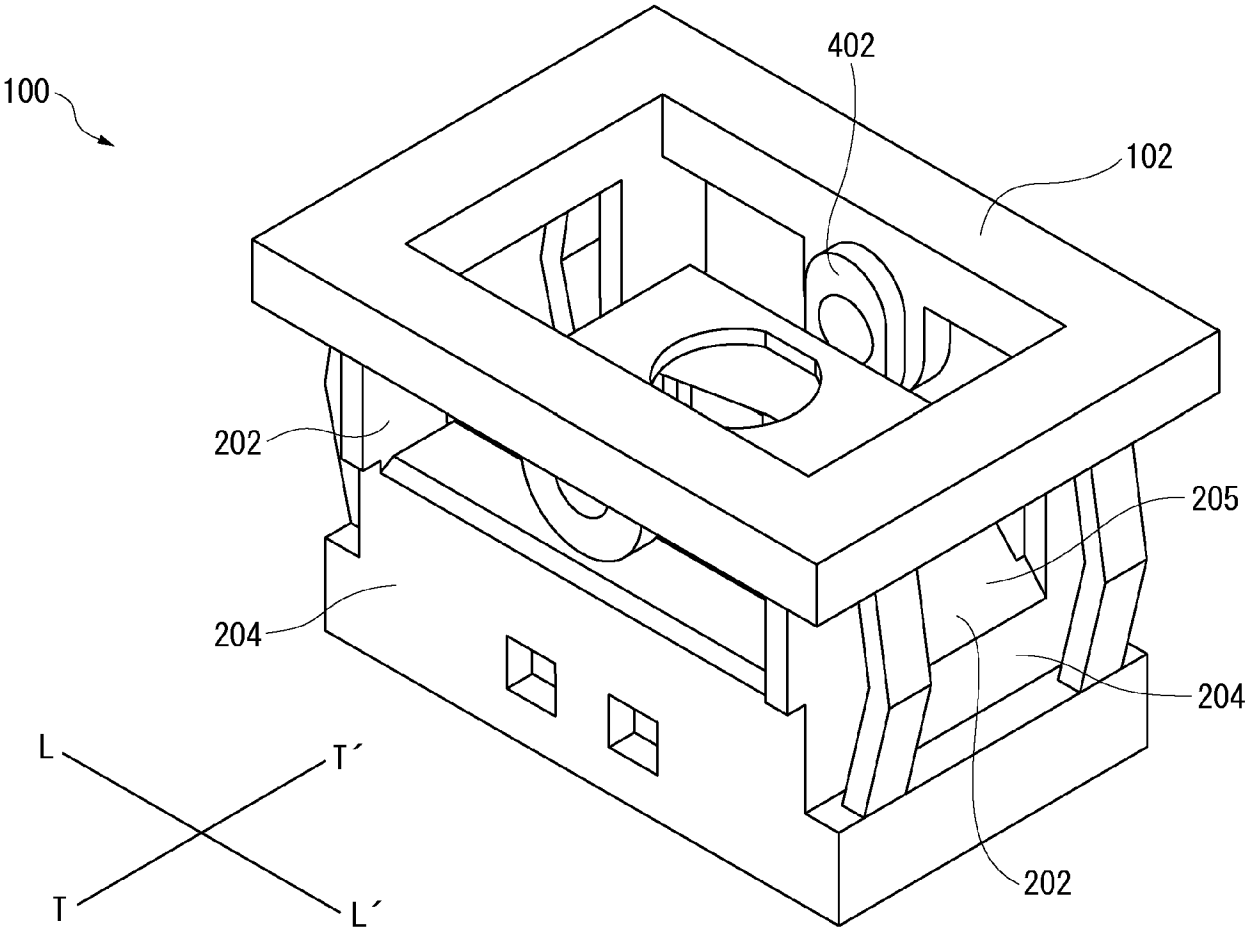
FIG. 4 illustrates a chamber of the switch device, according to a second exemplary embodiment of the present invention.

FIG. 4 illustrates a perspective view of the chamber, according to the second exemplary embodiment of the invention. As shown in FIG. 4, the switch device 100 may include at least four holes 202 on the side walls 204 of the chamber 102. In the second exemplary embodiment of the present invention, the switch device 100 is provided with two holes 202 on the side walls 204 perpendicular to the longitudinal axis (LL') and two holes 202 on the side walls 204 perpendicular to the transverse axis (TT') of the chamber 102.

Further, in the second exemplary embodiment of the present invention as shown in FIG. 4, the side walls 204 of the chamber 102 may be sloped to extend from an interior of the chamber 102 to each of the four holes 202, which may enhance the discharge of external particulate material through the holes 202 provided in the switch device 100. In a modification of the present invention, the switch device 100 may include a separate member (not shown), with sloped surfaces, that may be accommodated in the chamber 102. In the second exemplary embodiment of the present invention as shown in FIG. 4, the separate member may be integrally formed with the chamber 102. In the modification of the present invention, the separate member may be glued to the chamber 102 of the switch device 100. The sloped surfaces of the separate member may extend from an interior of the chamber 102 to each of the four holes 202.

Figure 5:
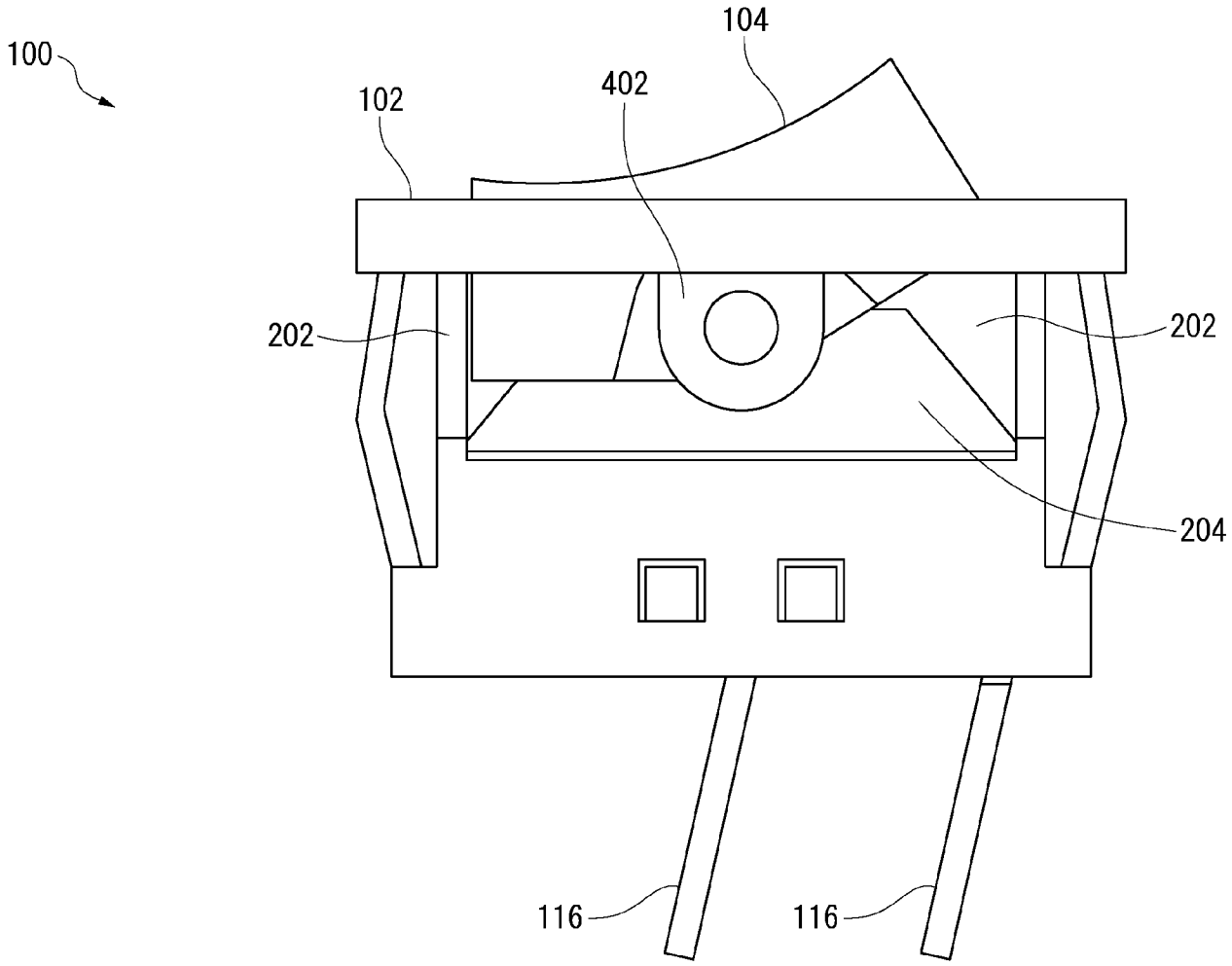
FIG. 5 illustrates a front view of the switch device of FIG. 4, according to the second exemplary embodiment of the present invention.

Further, as shown in FIG. 5, the switch device 100 may include at least one U-shaped frame 402 in the holes 202 on the side walls 204 perpendicular to the transverse axis (TT') of the chamber 102. In the second exemplary embodiment of the present invention, the U-shaped frame 402 may be attached on at least one side of the chamber 102 perpendicular to the transverse axis (TT'). In the second exemplary embodiment of the present invention, the U-shaped frame 402 may be made of insulating materials such as plastic or the like. In the second exemplary embodiment of the present invention, the U-shaped frame 402 may be utilized to retain various components of the switch device 100, for example, the operational member 104 and the contact member, in their respective positions.

FIG. 5 illustrates a front view of the switch device 100 of FIG. 4, in accordance with the second exemplary embodiment of the invention. Referring to FIG. 5, the switch device 100 may include four holes 202 on the side walls 204 of the chamber 102. The two holes 202 are provided on the side walls 204 perpendicular to the longitudinal axis (LL') of the chamber 102 and the other two holes 202 are provided on the side walls 204 perpendicular to the transverse axis (TT') of the chamber 102. Further, as shown in FIG. 5, the holes 202 present on the side walls 204 perpendicular to the transverse axis (TT') of the chamber 102 may accommodate the U-shaped frame 402. In a modification of the present invention, the U-shaped frame 402 may be an integral part of any other component of the switch device 100.

Figure 6:
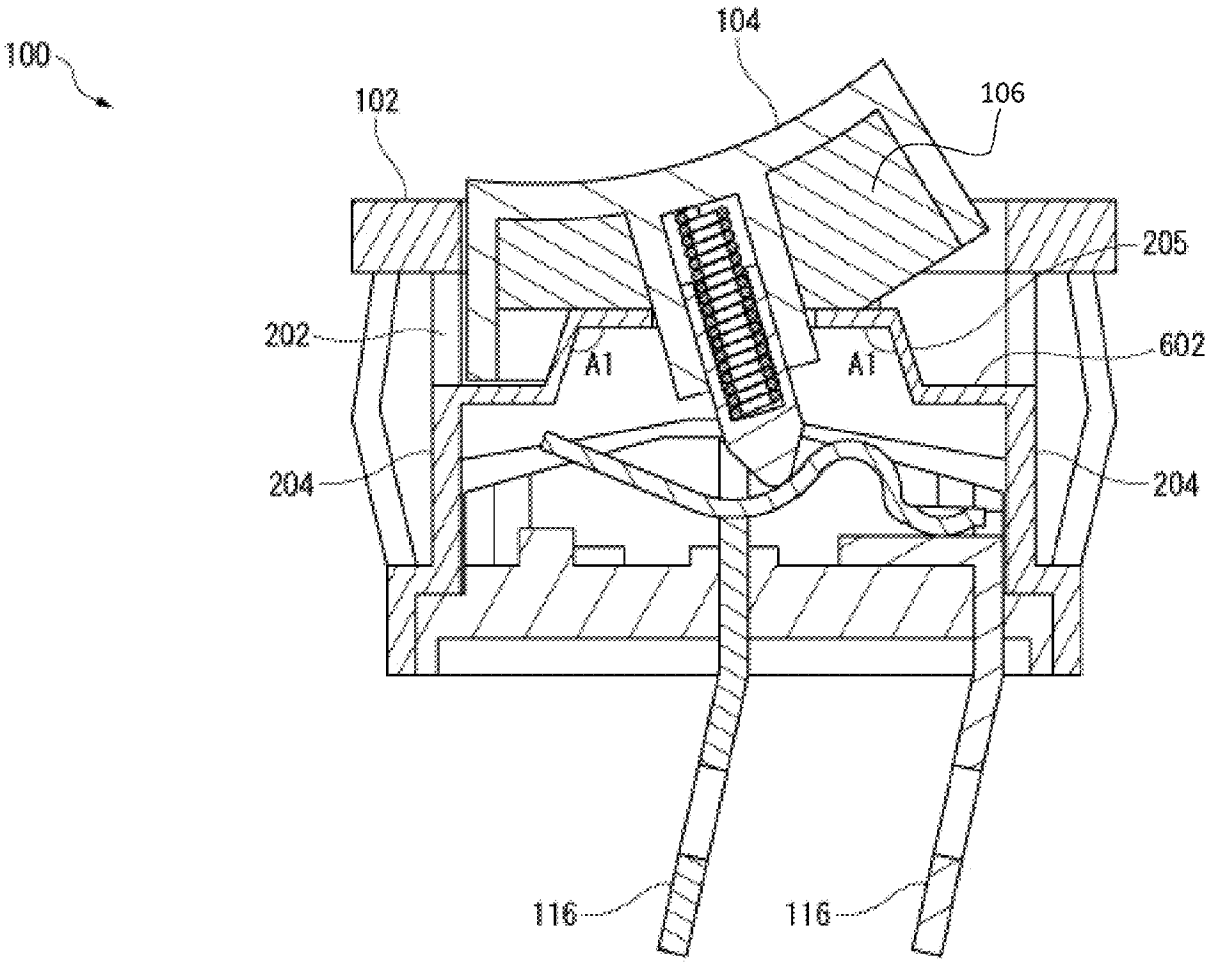
FIG. 6 illustrates a cross-sectional view of the switch device for, according to a third exemplary embodiment of the present invention.

FIG. 6 illustrates a cross-sectional view of the switch device 100 in accordance with the third exemplary embodiment of the present invention. In the third exemplary embodiment of the present invention, the switch device 100 may be provided with at least two holes 202 on the side walls 204 of the chamber 102. For example, the switch device 100 may include four holes 202: two on the side walls 204 perpendicular to the longitudinal axis (LL') and the other two on the side walls 204 perpendicular to the transverse axis (TT') of the chamber 102. Alternatively, the switch device 100 may include six holes 202: two on the side walls 204 perpendicular to the longitudinal axis (LL') and the other four on the side walls 204 perpendicular to the transverse axis (TT') of the chamber 102.

Figure 7:
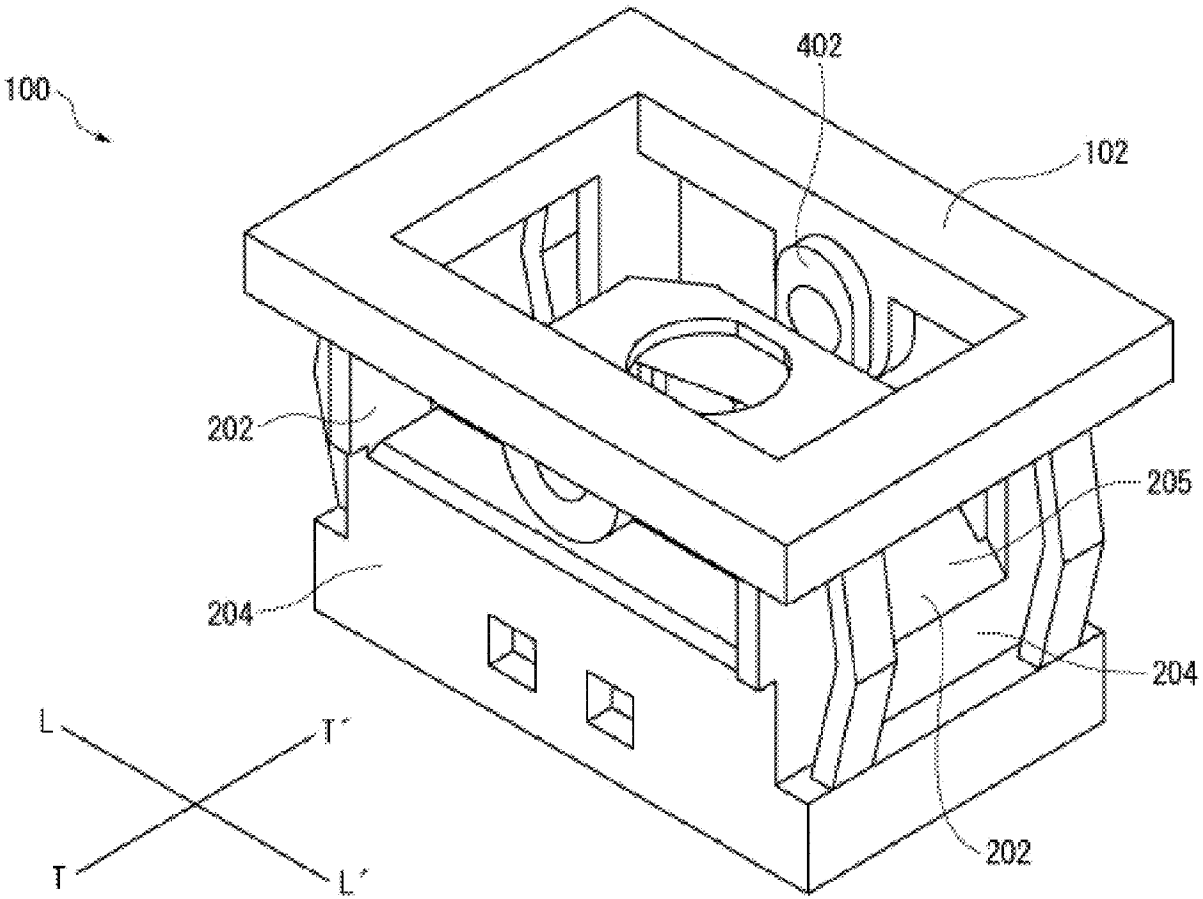
FIG. 7 illustrates a chamber of the switch device, according to yet another exemplary embodiment of the present invention.

Further, as shown in the exemplary embodiment of FIG. 6, the bottom surface 205 of the chamber 102 may have a variable inclination. In the third exemplary embodiment of the present invention, the bottom surface 205 may have a variable inclination with an extended flat surface 602 at both ends. The slope may be inclined at a first angle A1 with respect to the longitudinal axis (LL'). In the third exemplary exemplary embodiment of the present invention, the first angle of the slope may be in a range from about 30 degrees to 60 degrees. Further, the slope may be inclined at a second angle (as shown in FIG. 7) with respect to the transverse axis (TT') of the chamber 102. In the third exemplary embodiment of the present invention, the second angle of the slope may be in a range from about 30 degrees to 60 degrees.

Those of ordinarily skilled in the art will appreciate that the lengths of the holes 202 and the angle of the sloped surfaces 204 may depend upon the size and construction of the switch device 100 and the values provided in the specification are just for exemplary purposes and does not limit the scope of the present invention.

In the drawings and specification, there have been disclosed preferred embodiments and examples of the invention and, although specific terms are employed, they are used in a generic and descriptive sense only and not for the purpose of limitation, the scope of the invention being set forth in the following claims.

INDUSTRIAL APPLICABILITY

The present invention is applicable as a switch device for a hand-held power driven working tool.

REFERENCE SIGNS LIST

100 . . . switch device
102 . . . chamber

104 . . . operational member
106 . . . conducting plate
108 . . . elastic member
110 . . . pressing member
112 . . . contact plate
114 . . . additional chamber
116 . . . conducting terminals
202 . . . holes
204 . . . side walls
205 . . . bottom surface
402 . . . U-shaped frame
602 . . . extended flat surface
LL' . . . longitudinal axis
TT' . . . transverse axis

The invention claimed is:

1. A switch device comprising:

a chamber whose interior formed by surrounding side walls serves as an accommodation space; and an operational member at least partly located in the chamber, wherein a hole is provided on the surrounding side walls of the chamber, a bottom surface of the chamber is at least partly sloped extending from the interior of the chamber to the hole, and an elastic sealing member is interposed between the operational member and the bottom surface of the chamber, wherein the surrounding side walls of the chamber are shaped in accordance with the shape of the sealing member, and wherein the partly sloped bottom surface of the chamber is configured to enhanced discharge of particulate material.

2. A switch device according to claim 1, wherein the hole comprises at least two holes provided on the surrounding side walls of the chamber.

3. A switch device according to claim 1 wherein the hole comprises four holes provided on the surrounding side walls of the chamber.

4. A switch device according to claim 1, wherein the hole comprises six holes provided on the surrounding walls of the chamber.

5. A switch device according to claim 1, wherein the hole comprises at least two holes provided on the surrounding side walls perpendicular to the transverse axis of the chamber or the surrounding side walls perpendicular to a longitudinal axis of the chamber.

6. A switch device according to claim 1, wherein the hole comprises four holes provided on the surrounding side walls perpendicular to the transverse axis of the chamber.

7. A switch device according to claim 1, wherein the switch device is anyone of a rocker switch, a toggle switch or a push button switch.

8. A switch device according to claim 1, wherein the switch device is configured for use in a hand-held powered tool.

9. A switch device according to claim 1, wherein the bottom surface of the chamber is at least partly sloped with respect to both the longitudinal and traverse axes of the chamber.

10. A switch device according to claim 1, wherein the slope of the bottom surface of the chamber is in a range of about 30° to 60°.

11. A switch device according to claim 1, wherein the hole is configured to provide a passageway for particulate material.

12. A switch device according to claim 11, wherein the particulate material comprises dust.

13. A switch device comprising:

a chamber whose interior formed by surrounding side walls serves as an accommodation space; and an operational member at least partly located in the chamber, wherein a hole is provided on the surrounding side walls of the chamber, a bottom surface of the chamber is at least partly sloped extending from the interior of the chamber to the hole, and a sealing member is interposed between the operational member and the bottom surface of the chamber, wherein the bottom surface of the chamber is at least partly sloped with respect to both the longitudinal and transverse axis of the chamber, wherein the surrounding side wall of the chamber is shaped in accordance with the shape of the sealing member, and wherein the partly sloped bottom surface of the chamber is configured to enhance discharge of particulate material.

14. A switch device according to claim 13, wherein the hole comprises at least two holes provided on the surrounding side walls of the chamber.

15. A switch device according to claim 13, wherein the hole comprises four holes provided on the surrounding side walls of the chamber.

16. A switch device according to claim 13, wherein the hole comprises at least two holes provided on the surrounding side walls perpendicular to the transverse axis of the chamber or the surrounding side walls perpendicular to a longitudinal axis of the chamber.

17. A switch device according to claim 13, wherein the hole is configured to provide a passageway for particulate material.

18. A switch device according to claim 13, wherein the switch device is any one of a rocker switch, a toggle switch or a push button switch.

19. A switch device according to claim 13, wherein the switch device is configured for use in a hand-held powered tool.

20. A switch device according to claim 13, wherein the slope of the bottom surface of the chamber is in a range of about 30° to 60°.

* * * * *